United States Patent [19]

Izumi

[11] 4,126,313

[45] Nov. 21, 1978

[54] MECHANISM FOR SUPPLYING GOLF BALLS TO TEES OF A GOLF COURSE

[76] Inventor: Koji Izumi, 5-1, 7-chome, Mikagehonmachi, Higashinada-ku, Kobe City, Hyogo Prefecture, Japan

[21] Appl. No.: 756,394

[22] Filed: Jan. 3, 1977

[51] Int. Cl.[2] ..... A63B 57/00

[52] U.S. Cl. ..... 273/201; 124/50; 273/35 B

[58] Field of Search ..... 273/33, 201; 124/49, 124/50

[56] References Cited

U.S. PATENT DOCUMENTS

| | | | |
|---|---|---|---|
| 1,888,256 | 11/1932 | Baumgarten | 273/201 |
| 3,567,223 | 3/1971 | Gentiluomo | 273/201 |
| 3,580,583 | 5/1971 | Gentiluomo | 273/201 |
| 3,599,980 | 8/1971 | Harmond | 273/201 |
| 3,602,506 | 8/1971 | Gentiluomo | 273/201 |
| 3,966,213 | 6/1976 | Bradley | 124/50 |

*Primary Examiner*—Richard C. Pinkham
*Assistant Examiner*—T. Brown

[57] ABSTRACT

Mechanism for supplying golf balls fully automatically to tees of a golf course, exactly and without delays, for each of several players practicing or playing simultaneously, according to the shots of the golf balls by the players. An inclined main flow path is connected to a ball reservoir, and several inclined branch flow paths are connected in parallel to the main path. There is a first vane valve within a ball sending or discharging device, that opens and closes the main flow path, and a second vane valve within each of several flow change-over devices that open and close the paths from the main to the branch flow paths. A parallelogram link within a ball serving device, connected to the branch flow paths, raises each ball to a position where it can be shot. An electric eye detects if a ball is present on a tee or not. When balls are short in a branch flow path, an electric signal is made to a control circuit by the operation of a ball level inspection device. There are electromagnetic plungers for activating the first and the second vane valves, and for activating the parallelogram link; a switch in the inspection device and a photo-electric relay, activated by the electric eye, are connected in an electrical circuit.

9 Claims, 11 Drawing Figures

MECHANISM FOR SUPPLYING GOLF BALLS TO TEES OF A GOLF COURSE

This invention relates to a fully automatic mechanism for supplying or providing golf balls, exactly and without delays, to each tee of several players who practise shooting exercises simultaneously, according to the shots of the balls by the players.

Teeing and handling devices were invented in the past; all have complicated structures that may cause various troubles in use, although such devices are indispensable for fully automatically feeding devices that supply the balls to several tees on a golf or practice course, occupied simultaneously according to the balls that have been shot.

The principal object of the present invention is to provide a fully automatic ball supplying or feeding mechanism which has a simple structure, can be produced at low cost, is highly reliable, easily maintained, and durable, by which mechanism effective shooting exercises are economically assured. Hence it is possible to contribute to the rapid improvement of golf techniques and the useful development of the golfing sport.

Another object of the invention is to provide an exercising apparatus in which the balls are automatically distributed to branch flow paths with a high capacity, decreasing the required total quantity of balls for a particular exercising ground, and increasing the number of capable tees per mechanism.

A further object of the invention is to provde an exercising apparatus in which the entire ball transmission is fulfilled by the potential energy bestowed on the positions of the balls, which is completely independent of any other energy, with the exception of being lifted to the shooting positions.

Yet another object of the invention is to provide an apparatus or mechanism in which the displacements of the balls within a reservoir, main and branch paths and a ball serving device are fulfilled smoothly so that no transportation difficulties occur.

A further object of the invention is to provide an exercising apparatus in which the balls are distributed very accurately from the main flow path to each branch flow path so that no distribution difficulties are encountered.

Yet another and further object is to provide such an apparatus in which the balls are at a fixed position when they are shot and they are placed on the tees when the same become empty, following the shots by the players, and to provide such an apparatus in which ball level inspection devices detect the shortage of the balls in the branch flow paths.

Further objects, important features and inherent advantages of the invention will become better understood, in all of its aspects, from the following description when considered with the accompanying drawings, wherein FIG. 1 is a somewhat schematic overall diagram showing the inventive mechanism for supplying golf balls to tees of a golf course in a combined arrangement;

FIG. 11 is a similar circuit arrangement (EWD) for ball discharging control.

Figure 2:
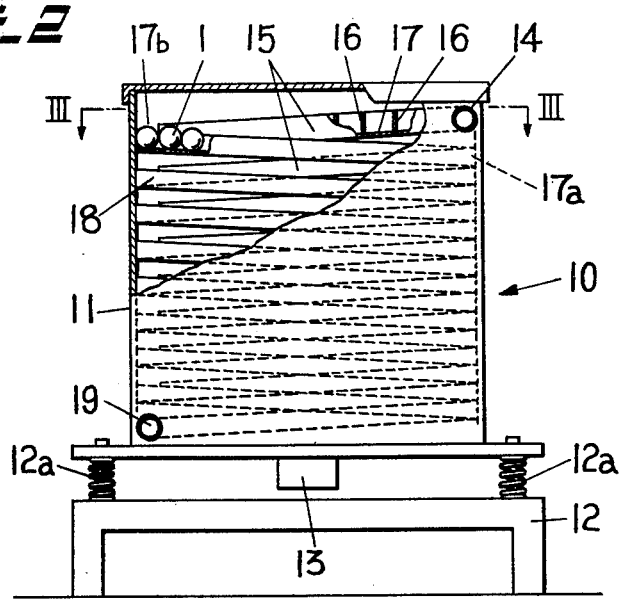
FIG. 2 is a partly sectional front elevation of a ball reservoir forming part of the inventive mechanism.
Figure 3:
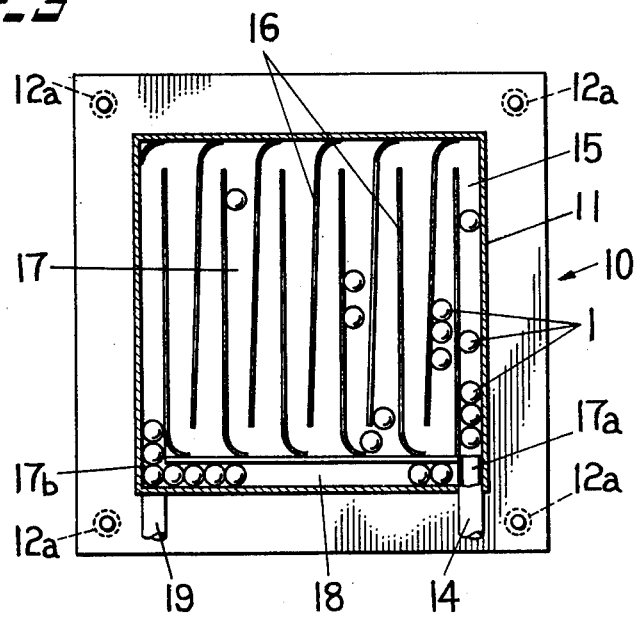
FIG. 3 is a horizontal cross-sectional view of the reservoir, taken on a plane designated by line III—III in FIG. 2.

In FIG. 1, a flexible main discharge pipe 19 is provided under a ball reservoir 10, to which a ball sending or discharging devide 20 is connected, and following this a main flow path pipe member 30 is formed, with several consecutive sections 32, having a falling gradient. Balls 1 being processed by the inventive mechanism are shown in FIGs. 2 and 3. The main flow path, the whole of which is designated by the numeral 30 includes a plurality of flow change-over devices 40, a tall pipe 31, a waste-ball reservoir 33 and the pipe members or sections 32 connecting them at appropriate distances (the uniform distances or lengths in FIG. 1 are for illustration only; on a golf course the lengths of all constituent members and elements are of course different and may run in various directions if necessary).

Branch flow paths of a falling gradient, each of which is designated by numerals 100, 200 . . . 900, are connected with main flow path 30 by an upwardly L-shaped branch flow or discharge pipe 51 connecting in the open condition with change-over device 40, and including a ball level inspection device 60, a ball serving device 90 and a branch flow path pipe member 52 to serve as an interconnection between devices 60 and 90, as shown in the several branch flow paths.

Figure 7:
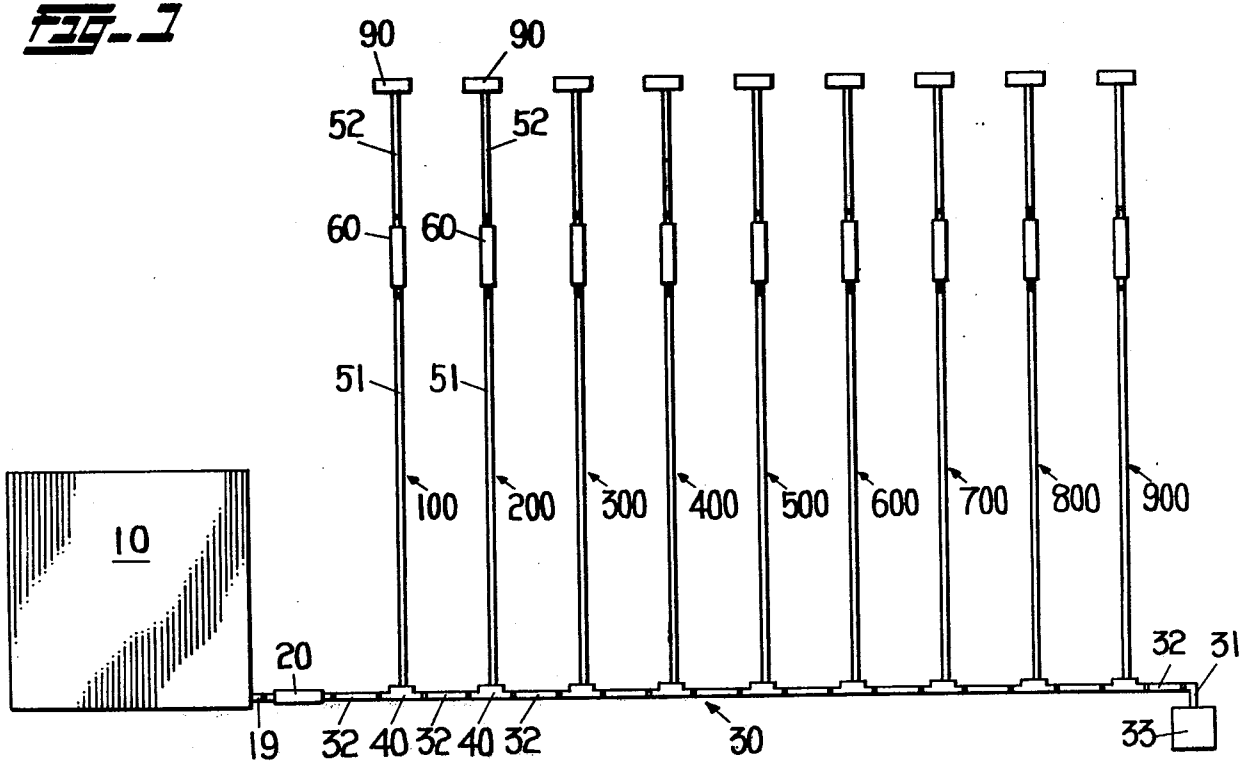
FIG. 7 is a vertical sectional view of a ball inspection device forming part of the inventive mechanism.
Figure 4:
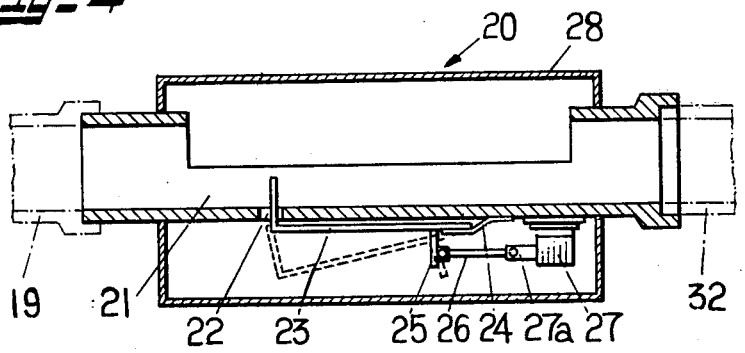
FIG. 4 is a longitudinal cross-sectional view of a ball sending or discharging device forming part of the inventive mechanism.
Figure 5:
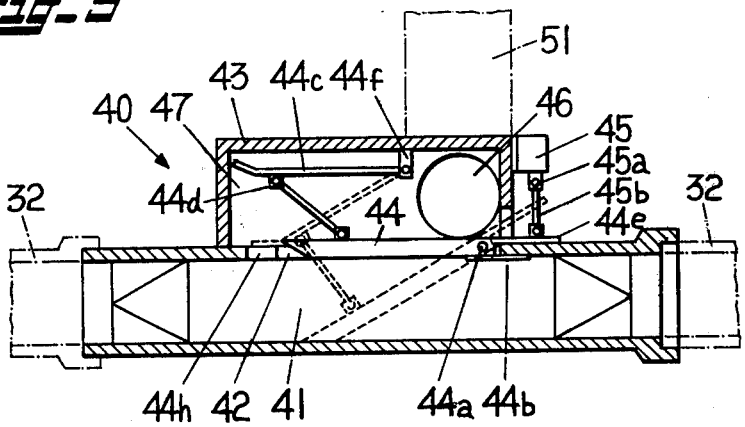
FIG. 5 is a horizontal cross-sectional view of a flow change-over device forming part of the inventive mechanism.
Figure 6:
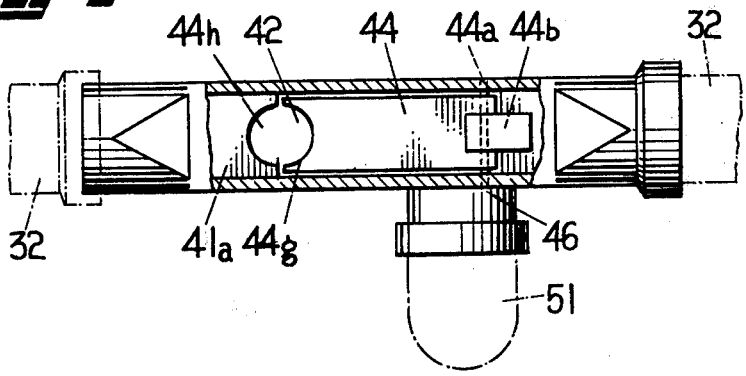
FIG. 6 is a partly sectional side view of the device of FIG. 5, seen from the front.
Figure 7:
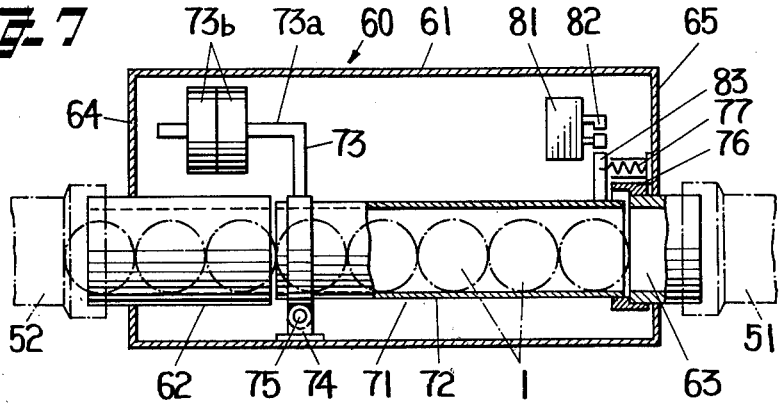

For a better understanding of the description that follows, and correlation of the schematic illustration of FIG. 1 with the remaining mechanical views of FIGS. 2 through 9, it should be noted that FIGS. 2, 3 illustrate reservoir 10; FIG. 4 shows device 20; FIGS. 5, 6 device 40; FIG. 7 device 60; and FIGS. 8, 9 devices 90. For each branch flow path there are separate devices 40, 60 and 90.

In FIGS. 2 and 3, ball reservoir 10 is shown being constructed as follows. A reservoir body 11 is provided, oscillatable at will on a stand 12 by means of a spring 12*a*, to vibrate by means of a known electromagnetic vibrator 13 and the like, secured beneath the surface of reservoir body 11. At the top of the latter, a receiving pipe 14 accepts the balls sent in order from a transporting tube connected to a reducer tube (these are not shown but will be described at the very end of the specification). Balls 1 that are introduced therefrom pass through winding path slopes 17 constructed by long rectifying plates 16 that are alternately straight at proper distances at each upper surface of inclined bottom plates 15 that are provided in multiple stages within reservoir body 11.

Then balls 1 drop by their potential energy until they arrive at an outlet 17*b* on each stage, provided at the ends of slopes 17 on bottom plates 15, and arrive at an entrance 17*a* provided at the uppermost of slopes 17 on plate 15 through bridging grooves 18 provided outside slopes 17. Then the balls drop along slopes 17 to reach outlet 17*b*, entering earlier-mentioned discharge pipe 19, which is preferably formed from a flexible pipe, at the very tip provided at the very bottom of body 11.

It is suggested, for both economic and operational points of view, to use lighter or easier descending slopes 17 and give more inclination to bottom plates 15, providing the vibrations with a proper frequency, amplitude and direction to the balls descending along slopes 17, instead of making them steeper. For this purpose vibrator 13 is provided, and flexible material is used for pipe 19 tp avoid harm to other portions, and yet produce effective vibrations, avoiding at the same time beating phenomena, etc.

In FIG. 4, ball sending or dicharging device 20 is constructed as follows. An end portion of an upper stream side of a valve shell 21 of a proper diameter has a window aperture at its inlet portion, connected with discharge pipe 19 of reservoir 10, while the end portion of the downstream side is connected on the opposite side with main flow path pipe 32. A piercing aperture 22 is provided in the lower side wall of shell 21, and the tip of a vane valve 23 projects loosely through aperture 22, thereby to prevent the flow of balls. The tip of valve 23 is bend upwardly, while the basic portion thereof is pressedly secured, capable of elevation down and out of shell 21 by the effect of a flat spring 24.

A downward arm 25 is also secured at valve 23, to which a link 26 is rotatable attached, and the free end of link 26 is provided at an iron core 27*a* of an electromagnetic plunger 27 (see also FIG. 11) secured on the outside bottom of shell 21. When plunger 27 is energized, valve 23 rotates downward, against the action of spring 24, and the tip portion thereof is withdrawn from shell 21. The blocking position of the valve tip is shown in solid lines while the withdrawn position is dotted. Ball discharging device 20 is preferably protected by a casing 28.

In FIGS. 5 and 6, flow change-over device 40 is shown, constructed as follows. A main-flow side valve seat or chamber 41, both of its end portions being of a round tubular shape of a proper diameter, while the central portion is of a square tubular shape, is connected with main flow path pipe 32; in a lateral wall of a main-flow side valve seat or chamber 41*a*, an aperture 42 is provided for the branch flow. An outer shell 43 surrounds aperture 42, and a valve seat or chamber 47 for the branch flow is formed between seat 41 and the outer shell.

A vane valve 44, one end thereof being supported by a shaft 44*a*, is formed to open and shut aperture 42 for the branch flow while valve 44 usually closes the aperture by a flat spring 44*b* secured near shaft 44*a*.

An electromagnetic plunger 45 (see a more detailed description later in connection with the flow path control circuit of FIG. 10 where several such plungers are shown at $45_1$, $45_2$, $45_3$ and $45_n$) is secured to the outer surface of shell 43, an iron core 45*a* being provided at an extension 44*e* of valve 44 through a link 45*b*, and thus the valve moves to the position designated by a dotted line in FIG. 5 against the force of spring 44*b* when plunger 45 is energized to open aperture 42. A projection 44*f* is formed on the internal surface of shell 43, to which a guide plate 44*c* is rotatably attached, parallel to valve 44. Plate 44*c* is connected with valve 44 by a link 44*d* so that they may rotate simultaneously.

A discharge pipe 46 is connected at the bottom plate of seat 47 for each branch flow path, to which branch flow path or discharge pipe 51 is connected. As shown in FIG. 6, a semi-circular hole 44*g* is formed at the end of vane valve 44, and a semi-circular hole 44*h* is in the lateral wall of valve seat 41*a* to provide ball passes that prevent the lateral wall of seat 41*a* and valve 44 from holding the balls between them, to prevent main flow path 30 from getting clogged even if there are balls in valve seat 41 when valve 44 is closed.

in FIG. 7, ball level inspection device 60 is shown as follows. Connection pipes 62, 63 pass through end surfaces 64, 65 of an outer shell 61, the outer ends thereof being connected with branch flow pipes 51, 52, respectively, and at prescribed distances from the opposite ends of pipes 62, 63 a bascule bridge device 71 is arranged at a short distance, balls flow here from right to left opposite to the illustrations of FIG. 1 and FIGS. 4–6. A bridge body 72 is held by a shaft 75 to a receiving member 74 fixed at the bottom of the inner surface of shell 61 by a link 73 secured to body 72, and the right hand end or tip of the latter rests at the lower end of the inner peripheral surface of a rotation limiting ring 76 that is secured at pipe 63, the body 72 being capable of limiting pivoted movement, being usually in the rest position. Numeral 77 will be mentioned somewhat later.

At the top of link 73 a horizontal arm 73*a* is formed, and on its uppermost end balance weights 73*b* are mounted. When bridge body 72 is full of balls 1, the tip portion of body 72 is maintained in the rest condition, at the bottom of the inner periphery of ring 76. A switch 81 is secured to shell 61, and a contact 82 of switch 81 is activated by being slightly raised by a lever 83 which is attached at the tip of bridge body 72 (see switches $S_1$, $S_2 \ldots S_n$ in FIG. 10 as counterparts of the switch 81). It will be understood by those skilled in the art that the weight or weights are chosen so as to properly counterbalance the requisite number of balls within body 72 to allow switch 81 to be closed only when the body is pivoted about shaft 75 when it is not full or the number of balls therein is reduced.

Lever 83 is connected to a spring 77 to prevent vibration to be transmitted to and from outer shell 61, and this spring prevents body 72 from unnecessarily activating switch 81 as a result of small vibrations.

Figure 8:
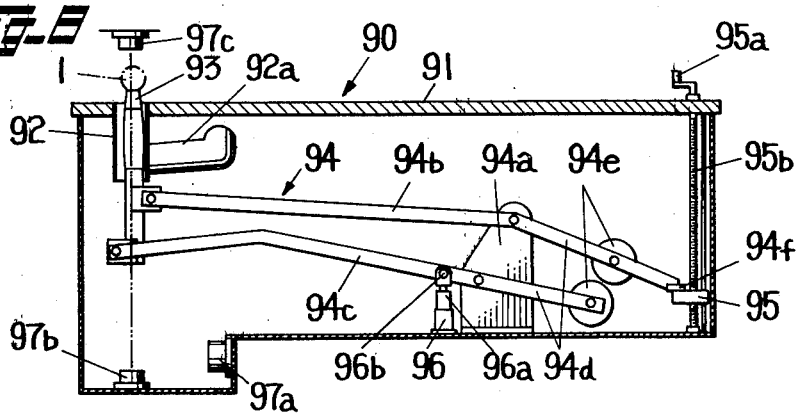
FIG. 8 is a vertical sectional view of a ball serving device also forming part of the inventive mechanism.
Figure 9:
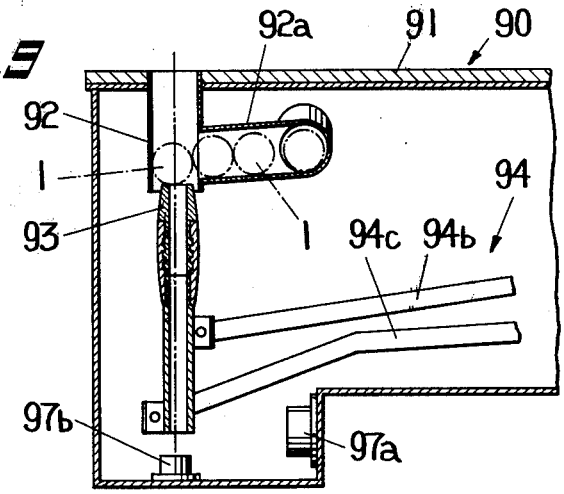
FIG. 9 is an enlarged side view of a main portion of the device of FIG. 8.

In FIGS. 8, 9 ball serving device 90 is constructed as follows. A guide tube 92 is placed at the prescribed distance around a tubular tee 93 that is provided vertically inside a casing 91 that has a leading port for the tee, and a ball providing pipe 92*a* connected with a respective branch flow path pipe 52 that meets tube 92 (see also FIG. 1). Tee 93 is supported by a parallelogram link device 94 which is pivotally supported and capable of elevation to move substantially vertically. Device 94 is provided as follows: one end of links (elements) 94*b*, 94*c* is mounted on a support 94*a* secured at a position on the bottom of casing 91 where tee 93 can move up and down without contacting any fixed object. The tee 93 whose upper portion is made of an elastic material is mounted on the other end of the links, a weight 94*e* being fixed to an extension 94*d* provided by folding the base end a little downward of upper link 94*b*, and a detent pawl 94*f* is formed at the tip of extension 94*d*.

Pawl 94*f* is formed to contact a detent nut 95 which is displacably carried on a threaded bolt 95*b*, the latter being rotatably provided upright in casing 91. The contacting position is determined by raising and lowering nut 95 by the rotation of bolt 95*b*, such as by operating a handle 95*a* that protrudes from casing 91. An electromagnetic plunger 96 is fixed at the bottom of the casing and link 94*c* is attached to a link member 96*b* mounted to an iron core 96*a*.

A photoelectric arrangement 97 is set opposite tee 93 in a perpendicular direction. This arrangement includes a light source tube 97*b* fixed just below tee 93, a light receiving tube 97*c* fixed at the proper position above the tee (see FIG. 8), a switch mechanism 97*a* that works with the incidence of the light from source 97*c*. It will be understood that the presence or absence of a ball above tubular tee 93 controls this photoelectric arrangement. When the ball is shot from above the tee (when the same is in the raised condition of FIG. 8), mechanism 97*a* is activated, energizing plunger 96, consequently core 96*a* descends whereupon the empty tee is pulled down or lowered quickly, near pipe 92*a*, by means of link device 94, whereafter the next ball rolls down or is pushed onto tee 93 where it is automatically centered above the hole therein.

From here on, the ball prevents the light from source 97*b* from reaching tube 97*c*, consequently plunger 96 is de-activated, link device 94 lifts tee 93 to the prescribed height, decided by the position of detent nut 95, namely by the gravity of weight 94*e*. This brings the tee to the shooting position, and once the ball has been shot by a player, the empty tee again descends to be loaded again with a ball, and so on.

If the speed deceleration of tee 93 is greater than that of the ball caused by gravity, when the upwardly moving tee is stopped because extension 94*d* is caught by bolt 95, it is possible that the ball slips out upwardly of the tee and drops out. Each movement of the ball serving and weight elements of the mechanism, caused by gravity, makes cosine changes in accordance with the displacement. By adjusting properly the angles between the respective levers of the elements, to establish different phase constants for these elements, and using a slight difference in the moment owing to the phase difference cause by gravity, in accordance with the displacement of parallelogram link 94, the time required for lifting the ball to the shooting position on top of the tee is reduced by increasing the difference at the lowest side of the mechanism. Furthermore, the ball is prevented from floating on top of the tee by minimizing the difference at the top when the tee stops in its upward movement.

The shape of tee 93 is made such that the balls within pipe 92*a*, which are prevented from rolling into tube 92 at the outer periphery of the tee, are not allowed to move as a result of the up-and-down movement of the tee.

In the following, the electrical circuits of the inventive mechanism will be explained for ball discharging device 20, flow change-over device 40 and ball inspection device 60, to distribute golf balls 1 automatically to branch flow paths 52.

Figure 10:
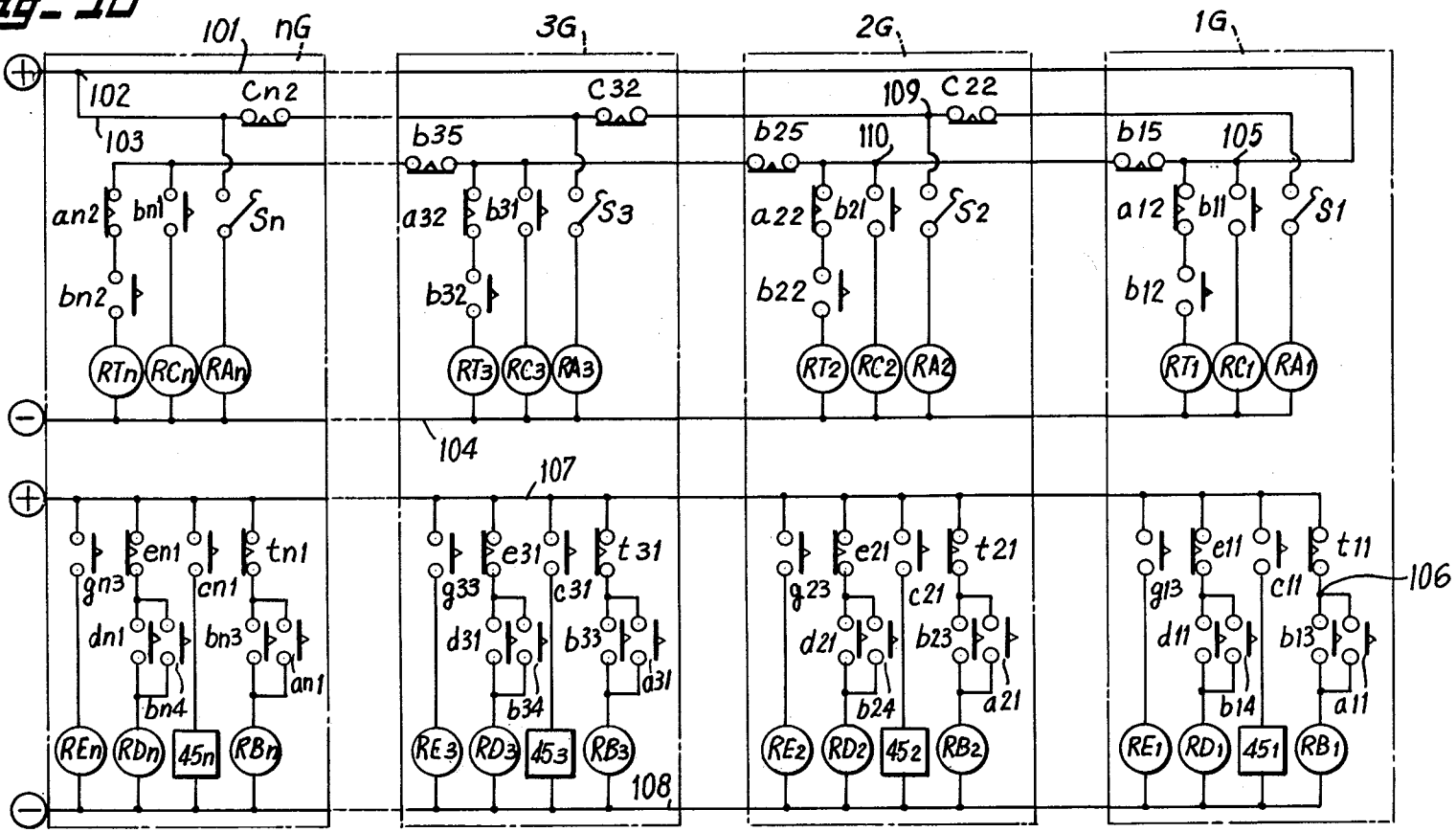
FIG. 10 is an overall circuit arrangement (sometimes called EWD for elementary wiring diagram) for flow path control in the inventive mechanism.
Figure 7:
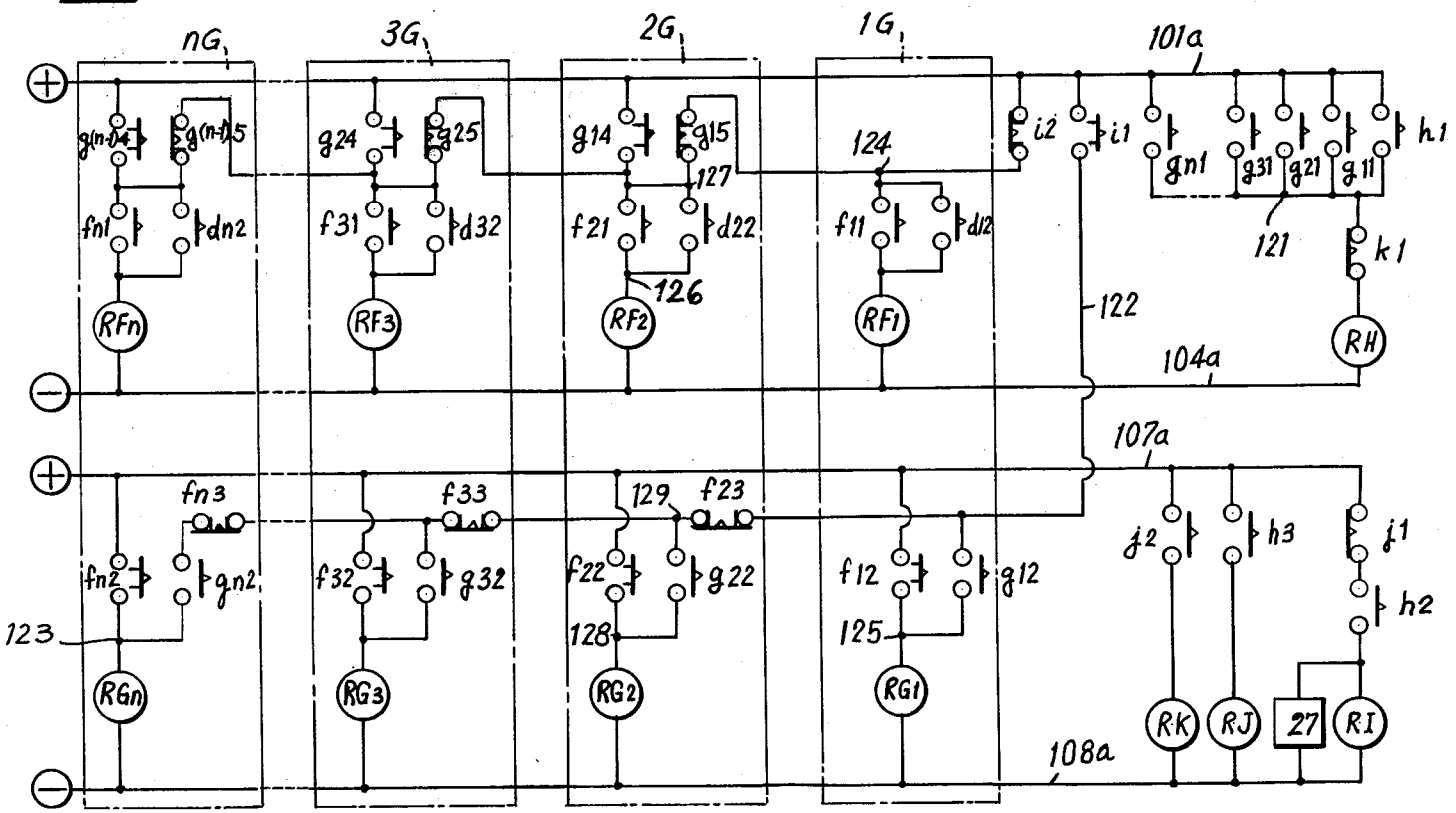

FIG. 10 shows the earlier-mentioned flow path control circuit in which a positive terminal at a wire 101 is connected with successive break contacts (also called "NC" or normally closed contacts), along the upper portion of the figure, as they follow from right to left, $b_{15}$, $b_{25}$, $b_{35}$ and $b_{(n-1)5}$ of respective relays $RB_1$, $RB_2$, $RB_3$ and $RB_{n-1}$ (not shown).

As will be fully described as the description proceeds, both FIGS. 10 and 11 are divided into successive units or groups from right toward left, such as 1G, 2G, 3G . . . *n*G, indicating that the total number of units is not limited since it can be increased or reduced according to the actual number of tees serviced by the inventive golf ball feeding or supplying mechanism.

Relay $RB_1$ can be seen in the lower right-hand unit 1G in the lower drawing portion, all circles indicating conventional, usually multi-contact relays. Solenoid-actuated plunger units, such as $45_1$ shown adjacent to relay $RB_1$, were mentioned earlier as "45" and are mechanically shown here by squares. All break and make contacts will be fully identified and described in the following, in some cases with particular correlations and timing requirements threof.

The earlier-described connection to contacts $b_{15}$ . . . $b_{(n-1)5}$ is by way of wire 101, from which a wire 103 branches off at a point 102, as will be described later. In the described chain, after contact $b_{35}$, a break contact $a_{n2}$ of a relay $RA_n$ is also connected, the other pole of contact $a_{n2}$ leading to a make contact (also called "NO" or normally open contact) $b_{n2}$ of relay $RB_n$, and the terminals of a timer $RT_n$, eventually to join a negative terminal or wire 104 of a common power supply. Wire 103, branching off from wire 101 at point 102, is connected with successive break contacts (this time from left to right) $c_{n2}$, $c_{32}$, $c_{22}$ of relays $RC_n$, $RC_3$ and $RC_2$, respectively, the point after last break contact $c_{22}$ going to a switch $S_1$, and the other pole of the latter to a relay $RA_1$, to join negative wire 104. It will be understood by those skilled in the art that all "make" and "break" contacts are identified as was explained earlier. Switch $S_1$ is the same as 81 of FIG. 7, as described.

A point 105 is shown in the right-hand top corner of the figure on wire 103 for the sake of convenience, and between that point and negative wire 104 is connected a make contact $b_{11}$ of relay $RB_1$, in series with a relay $RC_1$ whilst a break contact $a_{12}$ of relay $RA_1$, a make contact $b_{12}$ of relay $RB_1$, and a timer $RT_1$ are connected in series between wires 101 and 104. It will of course be understood by those skilled in the art that the connection of a "relay" means electrical connections to its coil terminals, and in a similar manner, a "timer" is connected by way of its electrical terminals. Terms like "wire" (101), "point" (102) and "terminal" are used interchangeably.

Coming now to the right-hand bottom portion of FIG. 10, make contacts $a_{11}$ and $b_{13}$ lead from a point 106 at one terminal of a break contact $t_{11}$ of timer $RT_1$, in parallel between a wire 107, similarly leading to the positive pole of the power supply, and a wire 108 that constitutes the minus pole. It will be understood that these positive and negative poles or wires may be connected to or separate from the respective wires 101, 104; 107, 108. Relay $RB_1$ is connected in series with the described contact arrangement. A make contact $c_{11}$ of relay $RC_1$ is connected in series with an electromagnetic plunger (or actually a solenoid thereof) $45_1$ between the positive and negative wires, whilst a make contact $b_{14}$ of relay $RB_1$ and a make contact $d_{11}$ of a relay $RD_1$ are connected in series with a break contact $e_{11}$ of a relay $RE_1$, in parallel across the power supply, and between these points relay $RD_1$ is also connected in series.

Still in the lower right-hand section, a make contact $g_{13}$ of a relay $RG_1$, the latter being shown in FIG. 11, is connected in series with relay $RE_1$ across the power supply. The details as have been mentioned and described so far can be designated the earlier-explained first unit or group, maked 1G.

The second unit, 2G, is to the left-hand side of the first unit. A switch $S_2$, similar to earlier-described switch $S_1$ is connected (in the upper portion of the unit) with a relay $RA_2$ between a point 109 located at the junction of break contacts $c_{11}$, $c_{32}$ and negative pole 104, and a make contact $b_{21}$ of relay $RB_2$ is connected with relay $RC_2$ between a point 110 on a junction wire between break contacts $b_{15}$, $b_{25}$ and negative wire 104. A break contact $a_{22}$ of relay $RA_2$, a make contact $b_{22}$ of relay $RB_2$ and a timer $RT_2$ are connected in series between point 110 (at the junction of break contacts $b_{15}$, $b_{25}$) and negative pole 104.

In the bottom figure portion, make contacts $a_{21}$, $b_{23}$ of relays $RA_2$, $RB_2$, respectively are connected with a break contact $t_{21}$ of timer $RT_2$, in parallel between supply wires 107, 108, and relay $RB_2$ is connected in series. Then, a make contact $c_{21}$ of relay $RC_2$ is connected with an electromagnetic plunger $45_2$ between supply wires 107, 108. Make contacts $b_{24}$, $d_{21}$ of relay $RB_2$ and of a relay $RD_2$, respectively, are connected in parallel with a break contact $e_{21}$ of a relay $RE_2$ between positive and negative poles 107, 108, and relay $RD_2$ is connected in series with this circuit.

A make contact $g_{23}$ of a relay $RG_2$, the latter being shown in FIG. 11, is connected with relay $RE_2$ in series between supply wires 107, 108. It will be clear from the preceding description that the units 1G, 2G are substantially identical in their circuit arrangements, except for the initially described chain-linked break contacts, of which $c_{22}$ was involved between the two described units.

The third group 3G is illustrated adjacent and to the left of the just described unit 2G, and then the circuits can be continued and multiplied, with identically interconnected units, as mentioned before, depending on the number of tees, to the leftmost unit *n*G. It will be understood by those skilled in the art, without referring specifically to the third or the last units, that switches $S_3$, $S_n$ are connected in a manner similar to those described earlier (e.g. $S_1$); there are additional relays $RA_3$, $RD_3$, $RD_n$, $RE_3$, $RE_n$ and another timer, $RT_3$, as well as plungers $45_3$, $45_n$, all as described before for the preceding units (only those not mentioned so far have now been mentioned).

Contacts similar to those described hereinabove are $a_{31}$, $a_{32}$, $a_{n1}$; $b_{31}$, $b_{32}$, $b_{33}$, $b_{34}$, $b_{n1}$, $b_{n3}$, $b_{n4}$; $c_{31}$, $c_{n1}$; $d_{31}$, $d_{n1}$; $e_{31}$, $e_{n1}$; and $t_{31}$, $t_{n1}$. It is provided that contacts $e_{11}$ . . . $e_{n1}$ open promptly when respective relays $RE_1$ . . . $RE_n$ are energized, but reclose with a certain delay when the respective relay is de-energized or cut off. Conversely, contacts $t_{11}$ . . . $t_{n1}$ open with a predetermined delay when respective timers $RT_1$ . . . $RT_n$ are energized.

Referring to FIG. 11, counting relays $RG_3$, $RG_n$ are shown, with make contacts $g_{33}$, $g_{n3}$ which are shown in FIG. 10, namely in the units 3G and *n*G, respectively.

In a manner well known from patent and other descriptions of electrical circuits, it will be understood that relay $RA_1$ has contacts $a_{11}$ and $a_{12}$ (the former being a make contact while the latter is a break contact); relay $RB_1$ has contacts $b_{11}$ through $b_{15}$; and so on. The lowercase letters identify the contacts of the relays that have the same capital letters, as is customary, each first digit in the contact designations referring of course to the number of the particular relay (if there are more than one). For a further example, contact $c_{32}$ belongs to relay $RC_3$.

FIG. 11 shows the earlier-mentioned control circuit for the ball discharging arrangement, wherein relays $RF_1$ through $RF_n$ are further relays for counting, to memorize or store the number of the balls discharged from the circuit of FIG. 10, and for instructing how the discharging operations are to be performed in a manner similar to the role of relays $RG_3$, $RG_n$, while the remaining are operational relays, similar to those of FIG. 10, namely $RA_1$ . . . $RE_n$, as have been discharged before where relays $RT_1$ to $RT_n$ were timing relays.

By way of a summary it can be stated at this point that there are four each of relays RA through RG and RT, of which those with letters A, C and D have each two contacts; B and G have five each; E and T have only one each; and the four relays RF have each three contacts. For the sake of completeness it should however be added that there is no need for contacts $b_{n5}$, $c_{12}$ and $f_{13}$. All the contacts of relays RD are make contacts; all of RE, RT are break contacts; and those of the remaining five relay groups have both make and break contacts. Special operational conditions have been and will be further explained at the appropriate descriptive locations.

Make contacts $h_1$ (right-hand top corner of figure), $g_{11}$, $g_{21}$, $g_{31}$ and $g_{nl}$ of a relay RH and of earlier-mentioned relays $RG_1$ to $RG_n$, respectively, are connected in parallel between a positive pole wire 101*a* and a negative wire 104*a*, similar in their association with the power supply to earlier-described wires 101, 104; the counterparts of wires 107, 108 will follow. A break contact $k_1$ of a timing return relay RK and relay RH are connected in series with the power supply, interconnected with the earlier-described contacts at an intermediate point 121. In a manner similar to what was mentioned earlier for contacts $e_{11}$ . . . $e_{nl}$, contact $k_1$ opens promptly when relay RK is actuated, but closes with a certain delay when this relay is disconnected from the circuit.

Coming now to the lower portion of the illustration, a break contact $j_1$ of a delay relay RJ, another make contact $h_2$ of relay RH, and a relay RI are connected in series, and the much earlier described plunger 27 of ball discharging device 20 lies parallel to relay RI between another positive wire 107*a* and another negative wire 108*a*. A make contact $h_3$ of relay RH, delay relay RJ, a make contact $j_2$ of the latter relay, and relay RK are connected respectively parallel to the described series circuit. As a particular relationship it should be added here that contact $j_2$ closes with a delay when relay RJ is energized, and contact $j_1$ opens. When the relay is cut off contact $j_2$ opens immediately and contact $j_1$ closes.

As a continuation of the earlier summary on some of the described relays, it can now be additionally stated that there are individual relays RH through RK, each having plural contacts except RK which has only one, a break contact. The contacts of relay RH are three make contacts, and all those of relays RI and RJ are mixed (one make, one break).

Referring now again to the top figure portion, a make contact $i_1$ of relay RI, a wire 122, break contacts $f_{23}$, $f_{33}$, $f_{n3}$ of relays $RF_2$, $RF_3RF_n$, a make contact $g_{n2}$ of relay $RG_n$, and the latter itself are connected in series between positive and negative wires 107*a*, 108*a*. A make contact $f_{n2}$ of relay $RF_n$ is connected between positive wire 107*a* and an intermediate point 123. A break contact $a_2$ of relay RI is connected in series with break contacts $g_{15}$, $g_{25}$, $g_{(n-1)5}$ of relays $RG_1$, $RG_2$, $RG_{n-1}$. Contact $i_1$ closes before $I_2$ closes before $i_1$ opens.

Make contacts $d_{12}$, $f_{11}$ of relays $RD_1$ (FIG. 10) and $RF_1$, respectively, and relay $RF_1$ itself are connected between a point 124 joining contacts $i_2$, $g_{15}$ and the wire 104*a*, as illustrated.

Another make contact $f_{12}$ of relay $RF_1$ and relay $RG_1$ are connected in the lower illustration portion between positive and negative wires 107*a*, 108*a*, and the earilier-described wire 122 is also connected with a point 125 between the described elements, as shown, through a make contact $g_{12}$ of relay $RG_1$. The group of circuit elements just described is designated the first group 1G.

In the second group or unit, 2G, illustrated to the left of 1G, a make contact $g_{14}$ of relay $RG_1$ (on top), a make contact $f_{21}$ of relay $RF_2$ and the latter itself are connected in series between positive and negative wires 101*a*, 104*a*, and a make contact $d_{22}$ of relay $RD_2$ is intercalated between points 126 and 127.

In the lower part of the figure, a make contact $f_{22}$ of relay $RF_2$ and relay $RG_2$ are connected in series between the power-supply wires. A make contact $g_{22}$ of relay $RG_2$ is provided between points 128 and 129.

In the third and last units, to the left-hand side of FIG. 11, designated 3G and *n*G, those parts which have not been described so far will be understood from the preceding description, all circuits being substantially symmetrical, continous and interlinked from unit to unit. We have here contacts $d_{32}$, $d_{n2}$; $f_{31}$, $f_{n1}$; $f_{32}$, and $g_{24}$, $g_{32}$, $g_{(n-1)4}$; in addition to those that were mentioned at the end of the FIG. 10 description. Special operational conditions exist in that contacts $f_{12}$. . . $f_{n2}$ closes before the respective contacts $f_{23}$. . . $f_{n3}$ open (there is no $f_{13}$ contact, as mentioned earlier); and conversely, the second-mentioned contacts close before the first group of contacts opens. The relationship is similar between the contacts $g_{15}$, $g_{n-1)5}$ and $g_{14}$, $g_{(n-1)4}$ (there being no contacts designated $g_{n5}$ and $g_{n4}$). It should be understood that a group or unit "$(n-1)$G" is not illustrated, but in a particular circuit the two above-mentioned contacts had to be included in the left-hand top section of FIG. 11 (in unit *n*G).

From the functional standpoint, the control circuit for ball discharging (FIG. 11) can be roughly classified into three systems, namely a memorizing system, an operating system, and a calculating system.

The memorizing system, for remembering ball sending signals from the flow-path control circuit of FIG. 10, consists of relays $RF_1$ . . . $RF_n$, $RG_1$. . . $RG_n$, contacts $f_{11}$. . . $f_{n1}$, $f_{12}$. . . $f_{n2}$, $f_{11}$. . . $g_{n1}$, and the electric wiring that interconnects them.

The operating system, for making the ball discharging device 20 discharge repeatedly a fixed quantity of balls as long as the memory remains in the memorizing system, consists of relays RH, RJ, RK and contacts $h_1$. . . $h_3$, $j_1$, $j_2$, $k_1$, the plunger 27 and the connecting electrical wiring or circuit.

Finally the calculating system, for cancelling one memory unit in the memorizing system per ball discharging operation, consists of relays RI, $RF_1$ . . . $RF_n$, contacts $i_1$, $i_2$, $f_{11}$. . . $f_{n1}$, $f_{12}$. . . $f_{n2}$, $f_{23}$. . . $f_{n3}$, $g_{12}$. . . $g_{n2}$, $g_{14}$. . . $g_{(n-1)4}$, $g_{15}$. . . $g_{(n-1)5}$, and the electric circuitry.

Relays $RG_1$ . . . $RG_n$ are not only auxiliary relays, indispensable for the calculating system, but also elements to transmit the information from the relays $RF_1$. . . $RF_2$, which are the memorizing elements to the operating system through contacts $g_{11}$. . . $g_{n1}$.

In the following, the operation of the inventive mechanism will be described, for supplying golf balls to tees of a golf course. The balls are stored in reservoir 10 and partly in branch flow paths 52. In each tee in use, ball serving device 90, when noticing by the photoelectric arrangement that no ball is present on the particular tee, feeds and places a ball to the tee in question from flow path 52. It will be understood that one ball is discharged from this path at every tee shot by a player. This lowers the level or quantity of balls in respective flow path 52 and in tube 72 of ball level inspection device 60, resulting in that the tube moves upwards with its right-hand end, as shown, thereby making lever 83 operate contacts 82 of switch 81.

In the flow path control circuit of FIG. 10, switch 81 is represented by earlier-mentioned switches $S_1$ . . . $S_n$ (see FIG. 7 and its description). When a switch, for example $S_2$ between wires 109, 104 of the second group or unit 2G closes, relay $RA_2$ is operated, thereby opening break contact $a_{22}$ between lines 110, 104, and relay $RB_2$ is energized with the closure of make contact $a_{21}$ between lines 107, 108.

With the energization of relay $RB_2$, break contact $b_{25}$ (behind point 1 on line 101) opens, electric power is cut off to relays $RC_3$ . . . $RC_n$ and $RT_3$ . . . $RT_n$ of the lower groups 3G . . . *n*G, make contact $b_{23}$ between wires 107, 108 closes, and relay $RB_2$ holds itself. At the same time make contact $b_{21}$ between points 110, 104 closes and relay $RC_2$ is also energized. Make contact $b_{22}$ also closes after break contact $a_{22}$ opens. Thus timer $RT_2$ does not function. After contact $a_{22}$ has opened, while contact $b_{22}$ closes and timer $RT_2$ is now ready to function, namely with the closure of contact $a_{22}$ due to the extinction of relay $RA_2$ when switch $S_2$ is released (opened).

With the energization of relay $RC_2$, break contact $c_{22}$ on line 103 opens, power is cut off to relay $RA_1$ of the upper group 1G, make contact $c_{21}$ between lines 107, 108 closes, and energizes plunger $45_2$ of flow change-over device 40 to open vane valve 44. Thus the balls move from main flow path 32 to the ball supplying route from main flow path 32 to respective branch flow path 52 of the second group is formed. Until the supply of balls to the second tee is completed, electric power is cut off to relay $RA_1$ of group 1G, for the electric power is cut off to relay $RA_1$ of group 1G, for the upper tee located near the ball reservoir, and to relays $RC_3$ . . . $RD_n$ of the groups 3G . . . *n*G, for the lower tees located farther away from the reservoir. It will thus be understood that the forming functions of the discharging paths (that is the opening of vane valves 44) are prevented to any and all other tees than the second tee (group 2G).

On the other hand, with the energization of relay $RB_2$, make contact $b_{24}$ between the same points 107, 108 closes, relay $RD_2$ is activated and holds itself with the closure of make contact $d_{21}$. At the same time make contact $d_{22}$ between points 126, 127 of the second group 2G in the ball discharging control circuit of FIG. 11 is closed. With the closure of contact $d_{22}$, electric current runs from line 101*a* through break contact $i_2$, point 124, break contact $g_{15}$, point 127, make contact $d_{22}$ and point 126 to relay $RF_2$ to excite and energize the same.

With relay $RF_2$ energized, make contact $f_{21}$ closes, the described circuit from line 101*a* through break contacts $i_2$, $g_{15}$, point 127 and make contact $f_{21}$ to point 126 is connected, relay $RF_2$ holds itself, closes make contact $f_{22}$ between points 107*a*, 108*a*, energizes relay $RG_2$, and break contact $f_{23}$ on line 122 opens, before point 129. As a result, any interfering electric current from the group 2G is cut off by way of point 125 to relay $PG_1$ so that this 9 relay, having been energized earlier, drops out with the opening of make contact $i_1$.

With relay $RG_2$ energized, make contact $g_{22}$ between points 129, 128 closes and break contact $g_{25}$ opens, to cut off any interferring current from the lower groups 3G . . . *n*G by way of point 126 to relay $RF_2$. As a result, the latter relay is cut off when break contact $i_2$ opens, as will be mentioned hereafter, and at the same time make contact $g_{24}$ closes to prevent the disconnection of counting relays $RF_3 \ldots RF_n$ of the lower groups, due to the opening of break contact $g_{25}$. As both contacts $g_{24}$, $g_{25}$ are equipped with lap contacts, that operate in a specially arranged manner, break contact $g_{25}$ opens after make contact $g_{24}$ closes, so that counting relays of the lower groups that are energized cannot be cut off due to the opening of contact $g_{25}$.

In the flow path control circuit 2G of FIG. 10, make contact $g_{23}$ between lines 107, 108 closes, relay $RE_2$ is energized, break contact $e_{21}$ opens, relay $RD_2$ is de-energized, and make contact $d_{22}$ of unit 2G in the ball discharging circuit (FIG. 11) opens. Relay $RF_2$ will not be cut off due to the opening of make contact $d_{22}$ because a self-holding circuit is already established through contact $f_{21}$.

With relay $RG_2$ being on, make contact $g_{21}$ between points 101*a*, 121 closes, relay RH is energized, make contacts $h_1h_2$ and $h_3$ thereof close, and relay RH holds itself. At the same time relay RI is energized, plunger 27 of ball discharging device 20 is energized, and vane 23 is pulled out of shell 21. The balls in reservoir 10 emerge from shell 21 and begin to move to main flow path 32.

With the energization of relay RI, make contact $i_1$ in line 122 closes, break contact $i_2$ between points 101*a*, 124 opens and relay $RF_2$ drops. Break contact $i_2$ opens after make contact $i_1$ closes because these are again lap contacts. Owing to relay $RF_2$ being off, make contact $f_{22}$ opens and break contact $f_{23}$ closes; however, as these are also lap contacts, contact $f_{22}$ closes before contact $f_{23}$ opens.

Before relay $RF_2$ drops out by opening of contact $i_2$, make contact $i_1$ closes and line 101*a* is connected with line 122. Then relay $RF_2$ is de-energized, and before contact $f_{22}$ opens, line 122 is connected with relay $RG_2$ by closing contact $f_{23}$. As a result, relay $RG_2$ is prevented from being released, following the dropping off of relay $RF_2$, which occurs when relay RI is energized.

The dropping of relay $RG_2$ at this stage immediately extinguishes counting relay $RF_3$ of the lower tee group 3G (for ex., if relays $RF_3$, $RG_3$ are energized), and relay $RG_3$, and similarly relays RF, RG of the lower groups that are energized are in turn cut off. Consequently all counting relays are instantaneously disconnected. Only relay $RF_2$ is thus cut off upon the energization of relay RI.

On the other hand, with the closure of make contact $h_3$ between lines 107*a*, 108*a*, delay relay RJ is energized. Some time after this relay is energized, make contact $j_2$ closes to energize timing return relay RK, and at the same time break contact $j_1$ opens and relay RI as well as plunger 27 of device 20 are cut off. Vane 23 returns to shell 21 owing to the dropping out of plunger 27, and this stops the balls in transit from reservoir 10 to main flow path 32. Thus, the release of a fixed quantity of balls ends from device 20 to main flow path 32.

Make contact $i_1$ opens owing to the dropping off of relay RI, to cut off power from line 101*a* to relay $RG_2$. The latter is disconnected, within the third group 3G make contact $g_{24}$ opens and break contact $g_{25}$ closes, and then the disconnection of counting relays $RF_3 \ldots RF_n$ of the lower group is made possible after all in accordance with the next opening of break contact $i_2$. As lap contacts are used for $g_{25}$, $g_{24}$, as mentioned earlier, the disconnection of the counting relay of the lower group does not actually occur by the respective opening and closing of these contacts. The reason is that, owing to the disconnection of relay RI, make contact $i_1$ opens after break contact $i_2$ closes, also as explained before, and relay $RG_2$ is disconnected. Then make contact $g_{24}$ opens, after the circuit from line 101*a* to relay $RF_3 \ldots RF_n$ of the lower group is connected (by way of points 124, 127) by closing of contact $g_{25}$.

Thus when ball discharging device 20 begins to function, and plunger 27 and relay RI begin to pull up, respective counting relay RF is disconnected, and respective counting relay RG is ready to be disconnected when the ball discharging function ends. When this is the case, after plunger 27 and relay RI are out of operation, counting relay $RG_2$ is disconnected and counting relay $RF_3 \ldots RF_n$ of the same lower group is ready to be dropped off when the next ball discharging function begins. Thus a pair of counting relays RF, RG is always de-energized in turn from the upper group toward the lower group at each ball discharging operation.

In the flow control circuit 2G (FIG. 10), make contact $g_{23}$ between lines 107, 108 opens owing to the inactive state of relay $RG_2$, timing return relay $RE_2$ drops off, and after a while break contact $e_{21}$ closes.

With the energization of relay RK of the ball discharging control circuit (FIG. 11), break contact $k_1$ opens, to cut off relay RH, make contact $h_3$ opens, whereupon relay RJ is cut off, make contact $j_2$ opens, relay RK is off, and break contact $k_1$ closes, thus completing the sequence of the ball discharging operation.

At this time, if there is a tee which requires the supply of a ball, the ball discharging operation described above is repeated, and with the energization of electromagnetic plunger 27, balls are released from respective device 20. However, as break contact $k_1$ closes some time after the disconnection of relay RK, owing to the timing return function, appropriate space becomes available between the groups of a fixed quantity of balls that are released from device 20, and the balls can be distributed more accurately to the playing tees.

A fixed quantity of balls discharged from the device into the main flow path moves toward tail pipe 31 along its slope, diminishing the potential energy, and they arrive at change-over device 40 of group 2G, passing through valve chamber 41 of the main flow side of device 40 of group 1G. In device 40 of group 2 (=2G), valve 44 is kept open so that the balls move from chamber 41 of the main flow side to chamber 47 along vane 44, drop into discharge pipe 46 and roll into branch flow path 52, passing through L-shaped branch flow path 51.

When the level of the balls in path 52 rises to a position where level inspection device 60 is located, body 72 is lowered, opening contact 82 by means of lever 83, turning off switch 81 and relay $RA_2$ is cut off by the opening of switch $S_2$ (between lines 109, 104) of flow path control circuit 2G (FIG. 10).

In accordance with the disconnection of relay $RA_2$, break contact $a_{22}$ closes, timer $RT_2$ operates, and then some time after the shifting of a fixed quantity of balls is completed, namely within main flow path 32 to branch flow path 52, break contact $t_{21}$ between lines 107, 108 opens, and thus relay $RB_2$ is disconnected, cutting off its own holding circuit. In accordance with the disconnection of relay $RB_2$, contact *contact*$b_{24}$ opens, make contact $b_{21}$ also opens, disconnecting relay $RC_2$, while break contact $b_{25}$ closes, connecting power to relays $RC_3 \ldots RC_n$ of the lower groups 3G . . . $n$G, thus the interception of the flow path forming function is eliminated at the lower tees of these groups.

As a result of relay $RC_2$ being off, make contact $c_{21}$ opens, cutting off plunger $45_2$ of device 40, vane valve 44 closes, blocking the ball discharging path from the main flow path to the respective branch flow path of tee 2G, then break contact $c_{22}$ on line 103 closes, feeding power to relay $RA_1$ of the upper group 1G; thus at the upper tees of group or unit 1G the interception of the flow path forming function is eliminated. After relay $RC_2$ drops out, some time later, timing return contact $e_{21}$ closes.

As contact $e_{21}$ closes after make contact $b_{24}$ opens, the ball discharging signal from group 2G (observe closure of make contact $d_{22}$) cannot be sent twice to the ball discharging control circuit of FIG. 11. The ball supplying process for the tee of group 2G is entirely completed by the described process. If balls have to be supplied only to one tee and if no other tees require the supply of balls, while the process of ball supply to that tee is finished, the operation of the ball distribution is the same as that described above for group 2G.

If several tees require balls to be supplied, the ball distribution mechanism operates with the required complexity and variety, in accordance with the positions of the tees, and in time when the balls are required by these tees.

Now the features of the present invention will be explained with regard to the process applicable to the ball distribution mechanism for various situations. As can be followed from the above explanations with regard to the second-group tees, the ball distribution mechanism forms a ball sending or discharging path to the tee which requires the supply of balls, and at the same time prevents such paths to other tees from being formed until the supply of balls to that tee is completed, preventing any interference from other flow paths. Main flow path 32 is used as an exclusive path to the tee which is being supplied. Then the balls are discharged from discharging device 20 to main flow path 32, having a suitable inclination, and are supplied to branch flow path 52 of the tee, by utilizing the weight or potential energy of the balls. This is the most fundamental principle of this inventive mechanism.

In the process of transferring a ball to a tee to which the path has been formed, if vane valves 44 of flow change-over device 40 of the upper tees open, a portion of a fixed quantity of balls in transit to the tee in main flow path 32 is diverted to the upper tees, which effects upon the exact distribution of the balls, or the balls are held between the lateral walls of main flow side seat 41*a* of the upper tees, clogging the path. Such an interference of the flow path has to be avoided.

However, if a requires requies the supply of balls at the side lower than the tees that are under the ball sending or discharging process, and even if vane valve 44 is opened as a result of the operation of device 40, the exclusive use of main flow path 32 by the tee under the ball transferring process cannot be interfered with because the balls flow in main flow path 32 from the upper side to the lower side. Therefore the opening of vane valves 44 of the lower tees does not affect the ball discharging paths to the upper tees.

The range of main flow path 32 exclusively used by a tee under the ball transferring process changes its position from the upper to the lowr side as time elapses. In other words, a certain portion of main flow path 32 is used only for a limited time by a tee under the ball supplying process. The use of main flow path 32, except for this limited time, is not contrary to this principle. For example, to transfer a fixed quantity of balls to the lower tees that require such balls, leaving some space behind the fixed quantity to the tee uner operation in main flow path 32 is not contrary either to this principle.

If a fixed quantity of balls is released to the lower tees (for example, to group $n$G) from ball discharging device 20 to main flow path 32, continuously following a fixed quantity of the balls to a certain tee (for ex., to the tee of group $(n-1)$G) under the ball supplying process, and if the supply of the balls to the lower tees (Group $n$G) is continued, terminating the branched path by completing the supply to the respective tee (of group $(n-1)$(G) under the process, the required time for dstributing the balls to these tees that require balls to be supplied is reduced in comparison to the following case. The ball discharging path to the upper tee (group $(n-1)$G) is formed, a fixed quantity of balls is released only for that tee from device 20 to main flow path 32, and after the path to that tee is terminated, by completing the supply of balls to the upper tee, a ball discharging path to the lower tee (group $n$G) is now formed, a fixed quantity of balls is released for that tee from device 20 to path 32, and then ball supply to the lower tee is completed. It will be noted that the time intercepting the ball discharging operation equals the time required to transfer the fixed quantity of balls released from device 20 to device 40 of the upper tee (of group $n$G) in main flow path 32 is not required.

The farther the position of the tee which requires the supply of balls is from device 20, the longer becomes the time intercepting the discharging operation to each tee. Consequently the more tees require the supply of balls, the more intercepting has to be done and thus the time lag becomes more evident.

However, as was mentioned above, if the balls are continuously sent in device 20 to the tees that require balls and, on the other hand, the ball discharging paths are destroyed to the upper tee in device 40 under the process of ball supplying, by completing the supply of balls, and at the same time, the sending or discharging path to the lower tee (group $(n-1)$G) is formed to supply the balls continuously, then the discharging operation has to function for the lower tees (group $n$G) which require supply independently from the flow path forming operation of these tees (group $n$G), and the flow path forming operation of the lower tees, at a time when the ball supply to the upper tee (group $(n-1)$G) is completed, should function independently from the ball discharging operation.

For the above reason, the control circuit in ball distribution mechanism is divided into the earlier-described ball discharging control arrangement and the flow path control arrangement (respective FIGS. 11 and 10). After a ball sending signal has been memorized, the time relationship between these operations is extinguished or canceled, and the continuous functions of the ball discharging and the path forming operations are made possible independently and at the required times, for ball distributions is reduced by preceding the discharging operations to the lower tees to the flow path forming operations.

The cancellation of the time relation between the described flow path and ball discharging control action is performed by relays RD, RE of the former circuit. In the following the tees of group 2G will be explained. It will be understood that reference to "relays RD" means relays $RD_1 \ldots RD_n$.

When the tee of group 2G requires the supply of balls, switch $S_2$ is closed (within device 60) and relay $RB_2$ is energized, following relay $RA_2$, then relay $RB_2$ holds itself; at the same time relay $RD_2$ is also energized and holds itself. As the tee in group 2G, where relay $RB_2$ is now self-holding, is warranted to form a ball discharging path immediately if the upper tee in group 1G is not under the ball supplying process, after the completion of the supply of balls to the upper tee of 1G is made if the latter is being under the ball supplying process.

For the tee in 2G under such a condition, counting relays $RF_2$, $RG_2$, corresponding to the tee (FIG. 11) are to be surely energized. This is the reason why relay $RD_2$ is energized by make contact $b_{24}$. With the closure of this contact, relay $RB_2$ holds itself, as mentioned before, and relay $RD_2$ is also energized, make contact $d_{21}$ closes and holds its relay, and make contact $d_{22}$ also closes.

The distribution of the balls to the tees that require the suply of balls, it will be understood, is made in a sequence from the upper tees to the lower ones. As the ball discharging operation proceeds to the flow path forming operation, at the tees positioned at both sides lower than a tee under the path forming process in the flow path control circuit (FIG. 10), and the side higher than a tee under the process of de-energizing the counting relays in the ball discharging control circuit (FIG. 11), the balls should be supplied, and thus the ball sending signal may take some time to be sent to the latter control circuit.

For example, when the tee of group *n*G following the tee of 1G and then 3G requires the supply of balls, the flow path to the tee of 1G is formed in the circuit of FIG. 10, and on the other hand counting relays $RF_n$, $RG_n$ are dropped following counting relays $RF_1$, $RG_1$, the ball discharging operation is already completed for two tees. Two groups of a fixed quantity of balls are thus being transferred in path 32, and yet plunger 27 is energized in order to start the ball discharging operation to group 3G, the release of balls from device 20 to main flow path 32 begins. At the same time relay RI is energized and after counting relay $RF_3$ is cut off, the tee of group 2G requires the supply of balls, and make contact $d_{22}$ closes.

It is needless to say that at groups lower than the group in which the counting relay is excited, at the groups (for ex. *n*G) lower than the group (1G) under the process of cancellation of the counting relay, as make contact $g_{14}$ is closed, relay $RG_n$ is activated, following counting relay $RF_n$, due to the closure of make contact $d_{n2}$, independently from the opening and closing of contact $i_2$.

As in the case mentioned above, contact $i_2$ is kept open, so it is impossible for counting relay $RF_2$ to be excited in accordance with the closure of make contact $d_{22}$ at the group 2G higher than the group 3G under the process of cancellation or dropping off counting relay $RF_2$. Furthermore the supply of balls to the tee 2G following the tee 1G is sometimes completed before relay $RF_2$ is energized upon closure of contact $i_2$. In this case, relays $RA_2$, $RB_2$ are disconnected successively, in accordance with the opening of switch $S_2$, and make contact $b_{24}$ has been opened, but relay $RD_2$ is kept self-holding without being de-energized as make contact $d_{21}$ is closed.

At the time one ball sending or discharging operation is completed by the de-energization of plunger 27, relay $RG_3$ drops off, the disconnection of counting relays $RF_3$, $RG_3$ is completed, and a new pair of such relays, $RF_2$, $RG_2$ is energized by the closure of contact $i_2$. As mentioned above, relay $RD_2$ stores or memorizes as it were for a time the ball sending signal in the flow path control circuit, until this signal is subsequently stored in the ball discharging control circuit (FIGS. 10, 11, respectively).

With relay $RG_2$ energized, make contact $g_{23}$ is closed, relay $RE_2$ is energized, break contact $e_{21}$ is opened, whereupon relay $RD_2$ drops off. After the ball sending signal is held for a time in the flow path control circuit, it is then stored by counting relays $RF_2$, $RG_2$ in the ball discharging control circuit, and thereafter the storage accomplished by the self-holding condition of relay $RD_2$ in the former circuit is canceled.

In the ball discharging control circuit, relay RH is energized after relays $RF_2$, $RG_2$ are pulled up, then ball discharging device 20 begins to send balls, simultaneously relay $RF_2$ is dropped, and after a fixed quantity of the balls is released, device 20 stops sending balls, and at the same time relay $RG_2$ is disconnected. Make contact $g_{23}$ is opened by the de-energization of relay $RG_2$ so that relay $RE_2$ is disconnected.

As the ball discharging operation usually precedes the flow path forming operation, as mentioned before, $RE_2$ is usually extinguished when relays $RA_2$, $RB_2$ are energized, that is, when make contact $b_{24}$ is closed. As the closure of contact $e_{21}$ at this stage again energizes counting relays $RF_2$, $RG_2$, the change of the state in the flow path control circuit 2G, following the dropping of relay $RE_2$, due to the opening of make contact $g_{23}$, is prevented by giving relay $RE_2$ a timing return operation. Relay $RG_2$ retains a state as if it were continuing to be excited for a time that is somewhat longer than the longest distribution time. After this time has passed, contact $e_{21}$ closes but the supply of balls to the tee has been completed and make contacts $b_{24}$ $d_{21}$ have been opened, so relay $RD_2$ cannot be energized.

As was mentioned earlier, the precedence of the flow path operations over the ball discharging operations for the tee of 2G is made possible by the self-holding circuit of relay $RD_2$, and the delay thereof is made possible by the timing return operation of relay $RE_2$. The relation of time between the ball discharging control operation of group 2G in the circuit of FIG. 10 and the flow path control operation of the same group in the circuit of FIG. 11 is eliminated. In other words, the ball sending signal is memorized for a time in the former circuit until the latter circuit can store that signal, making it possible that the flow path operation precedes the ball discharging operation. After the ball discharging control circuit of FIG. 11 makes it possible to store the ball sending signal, and when the storage of this signal is confirmed in FIG. 11, then the memory in FIG. 10 is erased. Furthermore the latter circuit is kept in the same condition as when the memory is kept in the circuit of FIG. 11 even if the memory is extinguished in the latter, with the completion of the ball discharging operation, making this operation to precede the flow path operation. As a result, as mentioned before, the relation of time between the ball discharging and the flow path operations is eliminated, and a continuous operation is make possible in both respects.

The sequence of occurrences of the tees requiring the supply of balls (1G–*n*G–3G–2G), the distribution sequence to these tees (1G–2G–3G–*n*G), and the de-energization sequence of the counting relays (also 1G–*n*G–3G–2G) do not usually correspond; however the ball discharging movement whose number is equal to that of the ball sending signals is repeated at the ball discharging control circuit of FIG. 11, and the ball discharging operation is thus completed. This circuit has the function, as explained before, to store or memorize the ball sending signal from FIG. 10, and as every ball discharge has numbers remaining of the sending times in the memory, and as every new occasion adds a new ball sending signal to the remainders, thus the circuit circuit has always the total number of remaining balls or ball discharging times in the memory.

Next, at the tees lower than the tee under the process of ball supply (for ex. group 2G), the ball sending signals for the tees requiring the supply (for ex. group nG) can be sent from the group *n*G of FIG. 10 to the corresponding group of FIG. 11 and the ball discharging operation can of course precede, and thus the required time for the ball distribution is reduced.

In FIG. 10 at the control circuit of the group 1G higher than 2G under the process of ball supply, as electric power to relay $RA_1$ is cut off by means of the opening of break contact $c_{22}$ on line 103, consequently relays $RB_1$, $RD_1$ cannot be energized following relay $RA_1$ even though switch $S_1$ may be closed. Therefore, relays $RF_1$, $RG_2$ are not energized. On the other hand, at the control circuit of the group nG lower than the group 2G, relays $RB_n$, $RD_n$ can be energized following relay $RA_n$ by the closure of switch $S_n$, then relays $RF_n$, $RG_n$ can be energized. In addition, relay $RC_n$ cannot be energized because power is cut off to this relay by the opening of break contact $b_{25}$ on line 101, and break contact $c_{n2}$ on line 103 cannot be opened.

This is important because a ball sending signal can be sent from group 3G of FIG. 10 to the same group of FIG. 11 when the tee 3G, at both sides higher than this tee *n*G, and the side lower than the tee 2G under the ball supplying process, require balls following this tee *n*G. With the closure of switch $S_3$, electric current flows from line 103 to relay $RA_3$ which is thus energized; then relays $RB_3$, $RD_3$ are energized, which allows relays $RF_3$, $RG_3$ to be activated. At the ball discharging control circuit the operation is continuously done in order to disconnect relays $RF_3$, $RG_3$ and relays $RF_n$, $RG_n$ after relays $RF_2$, $RG_2$; thus the ball discharging operations are completed before the flow path forming operations.

The reason why the flow path forming operations of the tee (1G) higher than the tee 2G under the ball supplying process is intercepted by the opening of break contact $c_{22}$ on line 103, and the flow path operations of the lower tees 3G . . . *n*G are intercepted by the opening of break contact $b_{25}$, is not only in the circuit of FIG. 11 the operations to the lower tees can precede the flow path forming operations, but also in the circuit of FIG. 10 the various flow path forming operations, to be described hereafter, are made only after the supply of balls is completed to the tee under the process of ball supply.

First, if there are tees which require the supply of balls at both the upper and the lower sides (for ex. 1G and 3G, respectively, as compared to the tee under the ball supplying process (for ex. 2G), the flow path to the lower tee is formed preferentially after the supply of the balls to 2G is completed. As was mentioned above, ball discharging operations to lower tees are operated in preference to flow path operations for these tees, so when the supply of balls to the tee 2G is completed, the fixed quantity of balls to the lower tee 3G, already released to main flow path 32 from ball discharging device 20, pases some time near flow change-over device 40 of the upper tee 1G.

The opening of vane valve 44 of device 40 of the upper tee in this condition may possibly divert a portion of the fixed quantity of balls for the lower tee to the upper tee, thus disturbing the accurate distribution of the balls, or this may shut the flow path, clogging the balls between the lateral walls of valve seat 41*a* and valve 44. To prevent this, in the circuit of FIG. 10, at the groups 3G . . . *n*G that are lower than the group 2G under the ball supplying process, it is always possible to energize relays $RB_3$ . . . $RB_n$, following relays $RA_3$ . . . $RA_n$, namely with the closure of respective switches $S_3$ . . . $S_n$. Thus, at the lower group 3G which may require the supply of balls, relay $RC_3$ can be energized promptly when break contact $b_{25}$ is closed as relay $RC_3$ is ready to be energized owing to the preceding closure of make contacts $a_{31}$, $b_{31}$.

On the other hand, in this group 2G, when the supply of balls to this tee is completed, then relay $RB_2$ is cut off following relay $RA_2$, and the closure of break contact $b_{25}$ makes it possible for relay $RC_2$ to be cut off by the dropping out of relay $RB_2$ before the closure of break contact $c_{22}$.

As a result, relay $RC_3$ of the lower group 3G is energized, break contact $c_{32}$ is opened, and then power is cut off to relay $RA_1$ of the upper group 1G before power is cut off from relay $RC_3$ of the lower group 3G by the opening of break contact $b_{15}$, due to the energization of relay $RB_1$, following relay $RA_1$ of the upper group.

Thus the ball discharging path to the lower-side tee 3G is formed preferentially, and vane valve 44 of device 40 of the upper-side tee 1G is prevented from opening.

Next, if there are several tees that require the supply of balls (for ex. 2G and 3G) at the tees 2G . . . *n*G that are lower than the tee 1G which is under the ball supplying process, the flow path to the uppermost tee 2G is formed preferentially, independently from the order of occurrence (for example, tee 3G requires the supply first, next 2G reaches that condition) after the supply of balls is finished to 1G.

During this process, while balls are supplied to the tee 1G, 3G also requires balls. In FIG. 10, unit 3G, switch $S_3$ is closed, relay $RB_3$ is energized following relay $RA_3$, relay $RB_3$ holds itself, and break contact $b_{35}$ opens. Relay $RC_3$ is not energized because power is cut off due to the opening of break contact $b_{15}$ so power is not cut off from relays $RA_2$, $RA_1$ of the upper units 2G, 1G without the opening of break contact $c_{32}$.

Then switch $S_2$ is closed, in the same order in group 3G relay $RB_2$ is energized following relay $RA_2$, relay $RB_2$ holds itself, power is cut off to relay $RC_3$ previously by opening break contact $b_{25}$, to prevent the disconnection of relay $RA_2$ due to the opening of contact $c_{32}$, following the energization of relay $RC_3$ due to the closure of contact $b_{15}$ when the supply of the balls to the tee 1G is completed in the process of ball supply.

As power has already been cut off to relay $RC_3$ by the opening of contact $b_{15}$, the condition of the control circuit in 3G does not change with the opening of contact $b_{25}$. When relay $RB_1$ is cut off following relay $RA_1$ by the completion of the ball supply to the tee 1G, and contact $b_{15}$ is closed, only relay $RC_2$ is energized, plunger $45_2$ is energized, and valve 44 is opened, so that the flow path to the tee 2G is formed preferentially.

Thirdly, if there are many tees which need the supply of balls only at the side (e.g. 1G, 2G) higher than the tee under ball supply (e.g. 3G), the flow path to the uppermost tee (1G) is preferentially formed independently from the occurrence order (e.g. first the tees of 2G, then those of 1G need the supply) after the completion of ball supplying to the tee (e.g. 3G). In the flow path control circuit of FIG. 10, relays $RA_1$, $RA_2$ are not energized by the closure of switches $S_1$, $S_2$ because power is cut off by the opening of break contact $c_{32}$ while the balls are supplied to the tee of 3G.

When this contact $c_{32}$ is closed after ball supply is finished, relays $RB_1$, $RB_2$ are energized following relays $RA_1$, $RA_2$, and at first break contacts $b_{15}$, $b_{25}$ are opened, then relays $RB_1RB_2$ become self-holding, and make contacts $b_{11}$, $b_{21}$ are closed and consequently (contact $b_{11}$) relay $RC_1$ is energized. However relay $RC_2$ is not energized with the closure of contact $b_{21}$ because power is already cut off by the opening of contact $b_{15}$. Plunger $45_1$ of device 40 is energized as a result of the activation of relay $RC_1$, valve 44 is opened, and the flow path to the tee of group 1G is formed preferentially.

In the circuit of FIG. 10, relays RB have the function of making the flow path for the upper-side tees preferentially, and relays RC have the function of making such a flow path preferentially for the lower-side tees. As mentioned earlier, relays RB can be energized at any time for the groups lower than the group under the process of ball supply, relays RC of the lower side requiring the supply being ready to be energized immediately by the closure of the break contacts in any upper-side group after the completion of ball supply to each upper-side tee which is under the process of ball supply.

On the other hand, in each group that is under ball supply, the break contacts of relays RC which cut off power to relays RA of the upper-side group close after the break contacts of relays RB close when ball supply is completed, thus relays RC of the lower-side groups are operated preferentially before relays RB of the upper-side groups are operated. Power is cut off to relays RB because only relays RC are operated, having the function of forming preferentially the ball discharging path of the lower-side tees, and these paths are so formed after the completion of ball supply to the tee which is under this process.

Again as mentioned before, at the groups lower than the group under the process of ball supply, as the energization of relays RC is prevented, relays RB are ready to be energized at any time, operating the function to form preferentially the flow path for any upper-side tee, and before the completion of the ball supply, a circuit was completed previously for preferentially forming a flow path for the uppermost tee among the tees of the lower side which needs the supply.

Referring again to what was explained earlier, the flow path for the uppermost tee is formed preferentially by the preferential energization of relays RB over that (those) of relays RC.

The flow path formation explained above can be summarized as follows: the distribution order of the tees that need ball supply is from the upper-side tee to the lower one (ones), from the lowest-side tee to the uppermost one, and again from the upper-side tee to the lower side, and this will be repeated in the same order.

In addition to this, when balls are being transferred to the lowest-side tee, the operation for forming a flow path for the upper-side tees is temporarily intercepted in the circuit of FIG. 10 until the supply of balls is completed in order to prevent the flow path from interfering, and also in the circuit of FIG. 11 after a fixed quantity of balls has been released to the lowest-side tee from ball discharging device 20 to main flow path 32, in that the ball discharging function is stopped for a moment.

The fixed quantity of balls is transferred in path 32 to the lowest-side tee, and when this supply is completed, the blocking of the flow path for the upper-side tees is cancelled in the circuit of FIG. 10. A ball discharging path is formed to the uppermost-side tee, the ball sending signal is sent from FIG. 10 to FIG. 11, whereupon the ball discharging operation resumes. Thus, the latter operation is stopped for a moment until the fixed quantity of balls is transferred from device 20 to the lowest-side tee in main path 32, and thus ball supply is completed. The longest waiting time for each tee is equal to that required for the balls to be transferred from device 20 to device 40 of the lowest-side tee, plus the time required for various fixed quantities of balls being sent to the branch flow paths.

The invention described in regard to the formation of the flow of balls being sent to the uppermost tee is made preferential in that the balls are distributed from the uppermost tees to the lower tees in an order independent from the occurrence order, the number of necessary repeated sequence times is reduced, and in that the intercepting time of the discharging operation is reduced, which corresponds to the reduced number. As a result, the whole time required for the distribution of the balls (namely to all the tees that require the supply of balls) is substantially reduced.

In regard to what was described earlier ("Next, if there are . . . ", and "Thirdly, if there are . . . "), if it depends upon the other control method by which the flow path formation to the tee 2G which requires the supply, cannot be made following the tee under the ball supplying process, the supplying of balls to all the tees that need balls cannot be completed by one cycle only but by another cycle, so the intercepting time for the ball discharging operation increases, which results in that the entire distribution time increases.

In order to reduce this time, it is necessary that the ball discharging operation precede the flow path operation to reduce intercepting while, for the ball discharging operation to each tee, and some groups of a fixed quantity of balls in the main flow path, should be distributed continuously to any tee. For this purpose it is necessary to equalize a requisite quantity of balls to be supplied to each tee regardless of the location of the tees.

In order to reduce the total required quantity of balls for the exercising ground it is necessary to reduce the number of balls to be supplied, thereby reducing waiting times for the distribution at each tee, and to reduce as far as possible the quantity of the balls supplied to each tee, yet supplying a sufficient number.

In the inventive mechanism, the waiting time for ball distribution at each tee is equalized by adopting a circular permutation in the distribution order so that the requisite quantity of balls remains equal at each tee, and yet the control circuit is subdivided into the earlier explained circuits of FIGS. 10 and 11, so that the flow path forming operation and the ball discharging operation can function independently, by eliminating the time relationships thereof. As a result, in the ball discharging control circuit, the fixed quantity of balls is continuously released from device 20 to main flow path 32, and in the flow path control circuit, some groups of balls sent to main flow path 32 are continuously supplied to any tee which requires the supply from the upper side to the lower side in succession. Thus the whole distribution time is reduced, the number of tees capable of being fed is increased in the mechanism, and the quantity of balls locally accumulated in branch flow paths 52 of the tees decreases, and as a result the total required quantity of balls is efficiently decreased for the entire golf field on which the inventive golf ball feeding mechanism is installed.

In the following the introduction of the supplying mechanism to a completely automatic golf ground will be described, which adopts the inventive automatic process of gathering balls shot from the tees to the supplying of the balls to them.

The balls can be easily collected at any desired place of the ground by providing suitable slopes (ups and downs) to gather the balls at a suitable place, giving them potential energy by using a conveyer, and then introducing the balls into a suitable ball transporting tube. Therefore, the procedure from collection of the balls on the ground to their supply to the tees can be made automatically by introducing the present supply mechanism.

As has been explained above, the flow of the balls in the present invention is a stream of a single file, while the flow of the balls from each tee to the ground, and then to a conveyer, and finally to a ball transporting tube, is a stream of gathering up an unlimited entity.

Therefore, the flow of balls should be connected to receiving pipe 14 of reservoir 10 after the flow is changed to a single-file flow by a suitable reduced provided on the transporting tube, which reduces the cross-section of the flow path.

In order to prevent the flow of balls from blocking such a transporting tube, it is necessary that the reducer be located at a place where the balls cannot stop. A reduction of the cross-section of the flow path and a change of the flow condition has to be avoided at the place where the balls may stop moving under certain conditions.

One method, as explained above, is to store the balls in reservoir 10, providing the reducer at a suitable place on the ball transporting tube.

Another available method according to the invention is to store the balls in groups in reservoir 10 which then has a suitable form and slope, providing the reducer at a suitable place, e.g. between ball sending device 20 and flow change-over device 40, or between the latter and branch flow pipe 52, thereby changing the flow of gathering up the balls into that of a single file at the place where the balls never stop moving.

It will be understood that the above description admits of various combinations, modifications, additions and substitutions, and that several details of both the mechanical and the electrical embodiments and arrangements can be designed and built differently. The invention is intended to cover all and any such modification, change, addition, combination of features and the like, as far as covered by the spirit and scope of the disclosed invention.

What I claim is:

1. A mechanism for supplying golf balls fully automatically to a plurality of tees (93) on an exercising ground, comprising: a ball reservoir (10) for containing a plurality of balls; a ball discharging device (20) connected to an outlet (19) of said reservoir, from which balls are released; inclined main ball flow-path means (30) connected to said discharging device for gravitally transferring balls released from the latter; each of said tees being provided with an inclined branch ball flow-path means connected to said main flow-path means for gravitally transferring balls released from said main flow-path means, in which balls are located, including means for preventing said branch flow-path means from becoming empty before balls are supplied from said discharging device; a ball flow changeover device (40) provided at the junction points of said main flow-path means and each said branch flow-path means to divert the flow of balls from said main flow-path means to said branch flow-path means; a ball-level inspection device (60) in said branch flow-path means, operating according to a quantity of balls in said branch flow-path means; a ball serving device (90) at the end of said branch flow-path means for supporting balls in a teed position to be hit by a player; and electric control circuits for selectively activating respective ones of said ball discharging device, said main flow-path means and branch flow-path means, said changeover device, said inspection device and said serving device, and for controlling the ball sending flow for said tee but preventing the flow of balls to any other tee until the supply of balls to said tee is completed.

2. The mechanism as defined in claim 1, wherein said electric control circuits include a ball discharging control circuit for controlling ball discharging operations to said tees independently from the control circuit operations of said ball sewing device; and a flow-path control circuit for controlling the ball flow-path operations independently from the ball discharging control circuit operations.

3. The mechanism as defined in claim 2, wherein said ball discharging control circuit includes a memory system with a number of memory units therein for retaining ball sending signals from said flow-path control circuit; means for repeatedly operating said discharging device (20) as long as said units are memory retained in said memory system; and calculating means for extinguishing one of said memory units per ball discharging operation.

4. The mechanism as defined in claim 1, wherein said ball reservoir includes a ball receiving opening at the top thereof and said outlet being at the bottom thereof, constituting a ball discharge opening; a plurality of inclined substantially horizontally extending, spaced apart rectifying plates, alternate ones of said plates being inclined in opposite directions to define a continuous gravital ball flowing path for balls from said ball receiving opening to said ball discharge opening; and means for oscillating said ball reservoir to enhance movement of balls through said ball flowing path in said reservoir.

5. The mechanism as defined in claim 1, wherein said ball discharging device includes a tubular shell member. having one of its ends attached to said ball reservoir outlet and its other end attached to an end of said main ball flow-path means; said member having an activatable spring biased vane valve attached thereto, said valve having a portion thereof adapted to extend through an opening in the wall of said member for selectively blocking the flow of balls through said member and retract to selectively allow balls to flow through said member; an elecromagnetic plunger attached to said member and said valve such that when selectively energized, said valve portion will be retracted to a ball release position against the bias of said spring and when de-energised said valve portion will return to its ball blocking position under the bias of said spring; said discharging device being lodged in a protective casing.

6. The mechanism as defined in claim 1, wherein said change-over device includes a shell and a substantially tubular chamber, one of the ends of said tubular chamber being attached in said main flow-path means, downstream of said discharging device for receiving balls therefrom; said shell being laterally attached to the wall of said chamber and the interior of said shell communicating with the interior of said chamber through an aperture provided in said chamber wall, said shell being attached to said branch flow-path means whereby balls are diverted from said main flow-path means through said aperture and said shell to said branch flow-path means; a spring biased vane valve means mounted on said chamber wall for selectively opening and closing said aperture whereby the flow of balls from said main flow path means to said branch flow-path means is selectively controlled; and an electromagnetic plunger connected to said vane valve means such that when energized said valve means will move to open said aperture which is closed by said valve means when said plunger is de-energized and said valve means is moved under the influence of said biasing spring.

7. The mechanism as defined in claim 1, wherein said inspection device includes an outer shell connected to said branch flow-path means and having a bascule bridge housed in said outer shell, said bascule bridge including a substantially tubular bridge member pivotally connected to said outer shell and constituting part of said branch flow-path means, said bridge member being capable of holding a predetermined number of balls; a weight member connected to said bridge member for counteracting the weight of balls in said bridge member by pivoting said bridge member when the actual weight of balls in said bridge member falls below a predetermined value; and a switch actuable by said bridge member upon pivoting of said bridge member by said weight member to activate said flow change-over device to divert the flow of balls from said main flow-path means to the respective said branch flow-path means.

8. The mechanism as defined in claim 1, wherein said ball serving device is a ball teeing machine housed in a protective casing, said teeing machine including a ball tee for holding a ball in said teed position, means connecting said tee to said casing for vertical reciprocation therein, means for activating said tee to cause said vertical reciprocation when a ball is hit from said tee, and ball teeing means for successively placing balls on said tee.

9. The mechanism as defined in claim 8 wherein said connecting means comprises upper and lower, spaced apart rigid links, each of said links being connected to said casing intermediate their ends for reciprocal movement in a vertical plane, said tee being attached to one end of each of said links such that it will reciprocate along and parallel to a vertical axis; said means for activating comprises a photoelectric arrangement whereby an electrical circuit will be activated when a ball is hit from said tee and will be deactivated when a ball is placed on said tee; an electromagnetic plunger connected to said casing, said lower link and said plunger being actuated by said photoelectric arrangement to lower said tee to a predetermined depth after a ball is hit from said tee; and weight means, said weight means being attached to the other end of said lower link and adjacent the other end of said upper link for raising said tee to a predetermined height after a ball is placed on said tee at said predetermined depth; and said ball teeing means being a guide tube connected to said branch flow-path means for transferring balls from said branch flow-path means to said tee when said tee is at said predetermined depth.

* * * * *

UNITED STATES PATENT OFFICE

CERTIFICATE OF CORRECTION

PATENT NO. 4,126,313

DATED Nov. 21, 1978

INVENTOR(S) Koji IZUMI

It is certified that error appears in the above-identified patent and that said Letters Patent are hereby corrected as shown below:

Column 4, line 68, change "displacably" to -- displaceably --;

column 10, lines 39 and 40, change "Thus the ... 32 to the" to -- The --;

column 20, line 34, change "tees" to -- tee --;

column 22, lines 19 and 31, correct the spelling of "change-over";

line 40, change "sewing" to -- serving --;

line 49, change "units are memory" to -- memory units are --;

UNITED STATES PATENT OFFICE

CERTIFICATE OF CORRECTION

PATENT NO. : 4,126,313

DATED : Nov. 21, 1978

INVENTOR(S): Koji IZUMI

It is certified that error appears in the above-identified patent and that said Letters Patent are hereby corrected as shown below:

column 23, line 11, correct the spelling of "de-energized";

line 29, hyphenate "flow path";

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*